US008613629B2

(12) United States Patent
Gong et al.

(10) Patent No.: US 8,613,629 B2
(45) Date of Patent: Dec. 24, 2013

(54) LOCKING MECHANISM FOR CONNECTOR

(75) Inventors: Xin-Hu Gong, Shenzhen (CN); Ju-Wen Dai, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 6 days.

(21) Appl. No.: 13/427,922

(22) Filed: Mar. 23, 2012

(65) Prior Publication Data

US 2013/0217255 A1 Aug. 22, 2013

(30) Foreign Application Priority Data

Feb. 22, 2012 (CN) ..... 2012 1 0040803

(51) Int. Cl.
*H01R 13/62* (2006.01)

(52) U.S. Cl.
USPC ..... 439/371

(58) Field of Classification Search
USPC ..... 439/371, 373, 304, 351, 545, 131, 133, 439/134
See application file for complete search history.

(56) References Cited

U.S. PATENT DOCUMENTS

| | | | | |
|---|---|---|---|---|
| 5,928,023 | A * | 7/1999 | Buckner et al. | 439/373 |
| 6,238,242 | B1 * | 5/2001 | Hwang | 439/545 |
| 6,394,817 | B1 * | 5/2002 | Kihira et al. | 439/76.1 |
| 6,485,316 | B1 * | 11/2002 | Chen | 439/135 |
| 6,589,064 | B1 * | 7/2003 | Chen | 439/304 |
| 6,811,415 | B2 * | 11/2004 | Chen | 439/133 |
| 6,966,792 | B1 * | 11/2005 | Willers et al. | 439/373 |
| 7,140,903 | B2 * | 11/2006 | Pulizzi et al. | 439/371 |
| 7,335,032 | B1 * | 2/2008 | Lee | 439/76.1 |
| 2002/0068477 | A1 * | 6/2002 | Chen-Chiang et al. | 439/373 |

* cited by examiner

*Primary Examiner* — Alexander Gilman
(74) *Attorney, Agent, or Firm* — Altis Law Group, Inc.

(57) ABSTRACT

A locking mechanism is used to prevent a connector coupled to an device from accidently disengaging from the device. A cable extends from the connector. The locking mechanism includes a supporting bracket fixed to the device, and a locking member mounted to the supporting bracket and slidable between a locking position and an unlocking position. The supporting bracket defines a retaining hole. The locking member includes a protrusion and a block. When the locking member slides to the locking position, the block abuts against the connector. The protrusion is engaged in the retaining hole to keep the locking member at the locking position. When the locking member slides to the unlocking position, the block is spaced from the connector to provide an operation space for removing the connector from the device.

5 Claims, 6 Drawing Sheets

LOCKING MECHANISM FOR CONNECTOR

BACKGROUND

1. Technical Field

The present disclosure relates to a locking mechanism for locking a connector to a device.

2. Description of Related Art

A peripheral device may be connected to an information handling device through a cable, which is associated with an connector coupled to the information handling device. However, the connector tends to be disengaged from the information handling device and accidentally interrupts the connection between the peripheral device and the information handling device. Therefore there is a risk of data losing, or even damaging the peripheral device and the information handling device.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION OF THE DESCRIPTION

Figure 1:
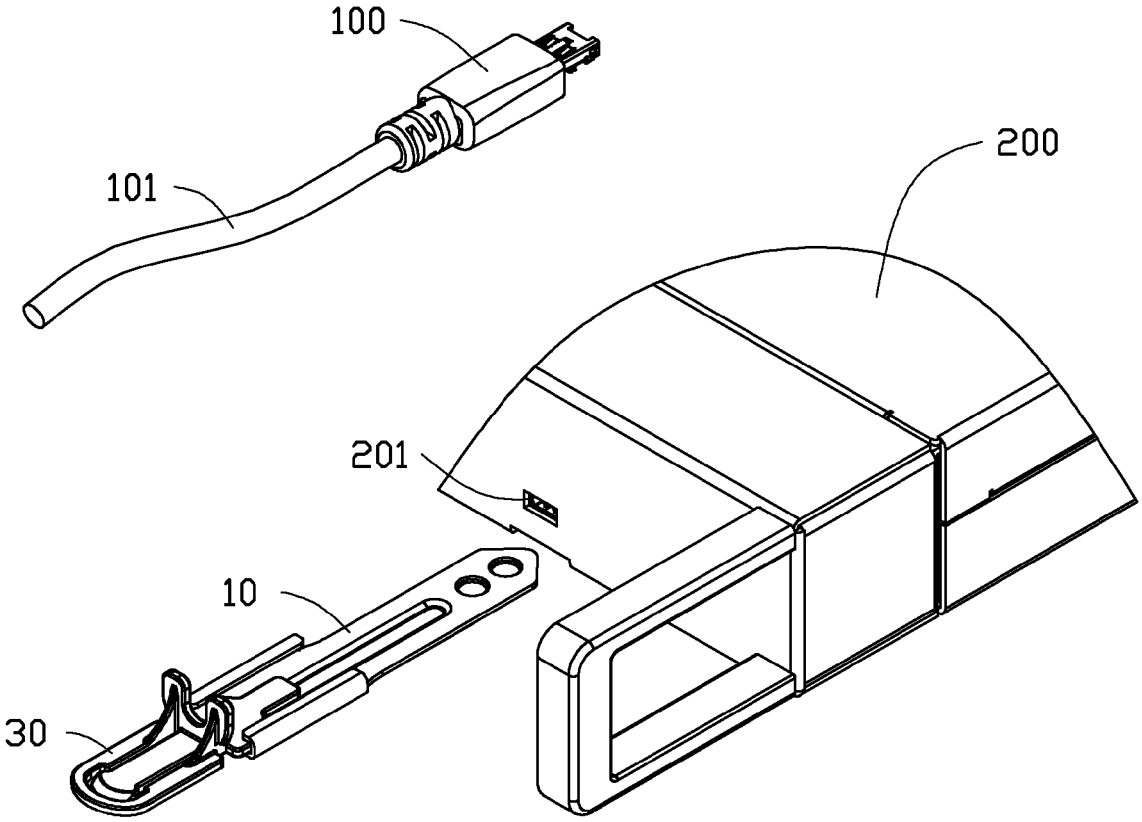
FIG. 1 is an exploded, isometric view of a first embodiment of a locking mechanism, a connector, a cable extending from the connector, and an information handling device.

Referring to FIG. 1, a first embodiment of a locking mechanism is used to lock a first connector 100 to an information handling device 200. A second connector 201 is formed on a front wall of the information handling device 200. A plurality of mounting holes (not shown) is defined in a bottom of the information handling device 200 adjacent to the second connector 201. A cable 101 extends from the first connector 100. The lock mechanism includes a supporting bracket 10 and a locking member 30.

Figure 2:
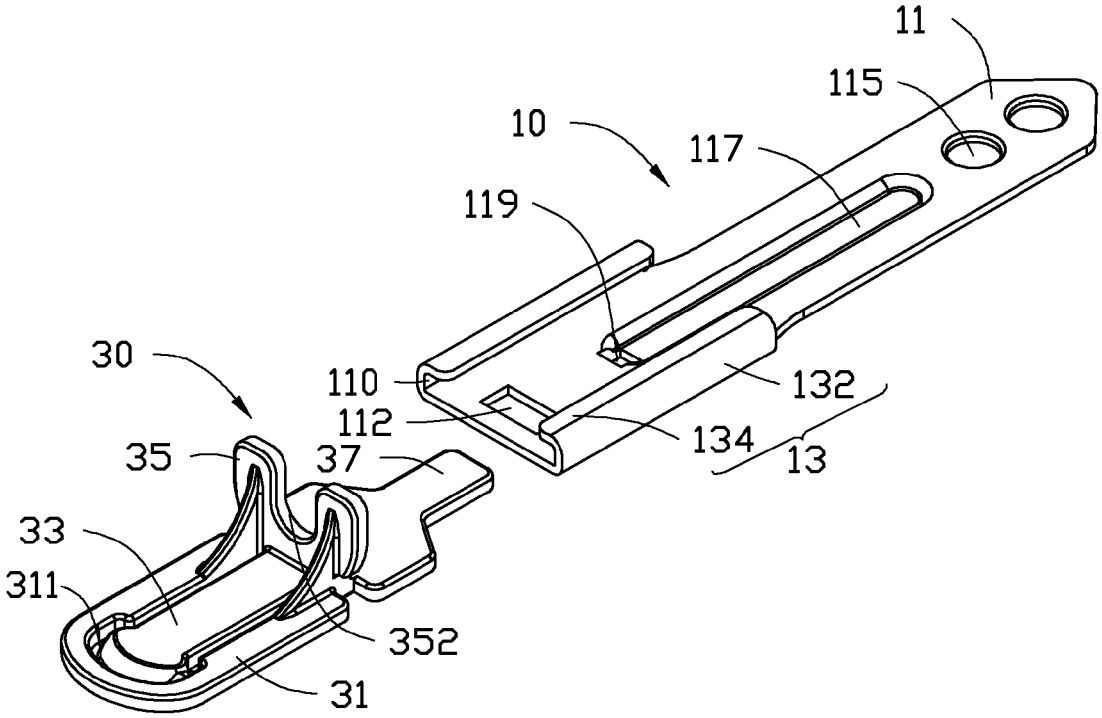
FIGS. 2 and 3 are exploded, isometric views of the locking mechanism of FIG. 1, viewed in different perspectives.
Figure 3:
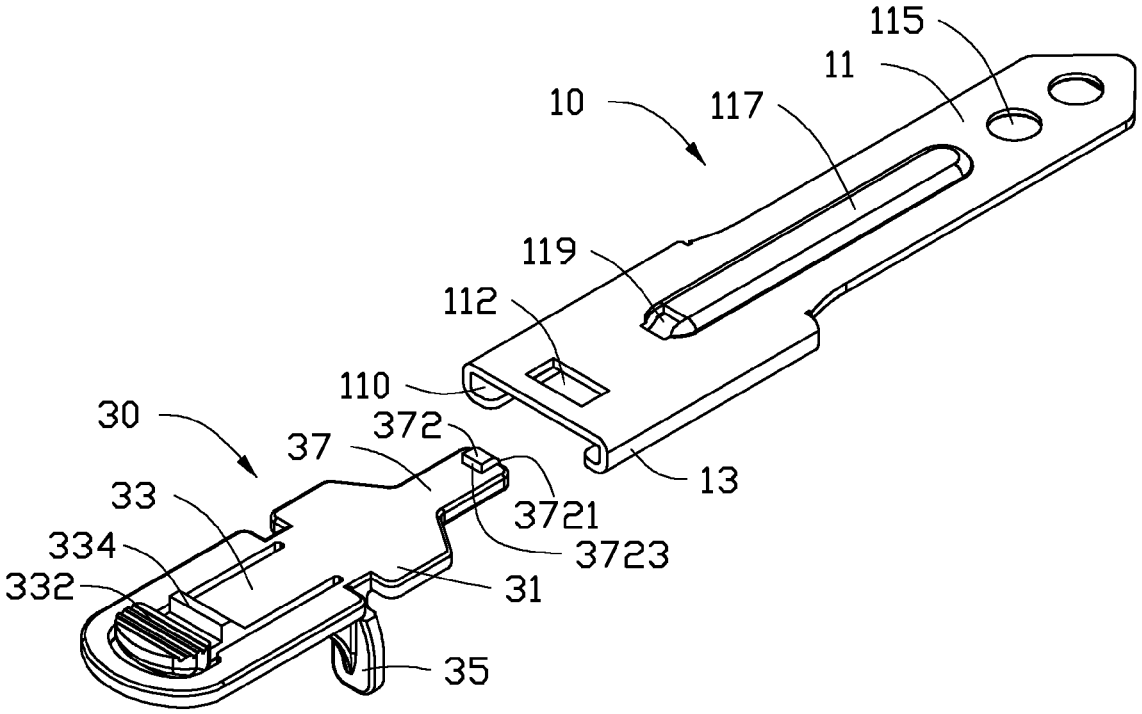

Referring to FIGS. 2 and 3, the supporting bracket 10 includes an elongated base board 11, and two sidewalls 13 extending from opposite sides of the base board 11 and adjacent to a front end of the base board 11. Each of the sidewalls 13 is substantially L-shaped, and includes a first portion 132 extending up from the base board 11, and a second portion 134 extending toward the second sidewall 13 from a top side of the first portion 132. A slide passage 110 is bounded by the base board 11 and the sidewalls 13. A retaining hole 112 is defined in the front end of the base board 11. A plurality of fixing holes 115 is defined in a rear end of the base board 11. A slide groove 117 is defined in the base board 11, extending along a lengthwise direction of the base board 11. A positioning hole 119 is defined in the base board 11, adjacent to a front end of the slide groove 117.

The locking member 30 includes a bottom plate 31, a resilient and cantilevered manipulation arm 33, a block 35, and an extension arm 37. The bottom plate 31 defines an accommodating hole 311. The manipulation arm 33 extends into the accommodating hole 311 from a rear wall bounding the accommodating hole 311. An operation portion 332 protrudes from a front end of the manipulation arm 33. A protrusion 334 protrudes from a bottom of the manipulation arm 33, adjacent to the operation portion 332. The block 35 substantially perpendicularly extends up from the bottom plate 31, adjacent to the rear end of the manipulation arm 33. The block 35 is substantially U-shaped, and defines a notch 352. The extension arm 37 extending rearwards from a rear end of the bottom plate 31, coplanar with the bottom plate 31. A stopper 372 protrudes from a rear end of a bottom of the extension arm 37. The stopper 372 defines a guiding side 3721 facing rearwards and slanting to the extension arm 37, and a stopping side 3723 facing forwards and substantially perpendicular to the extension arm 37.

Figure 4:
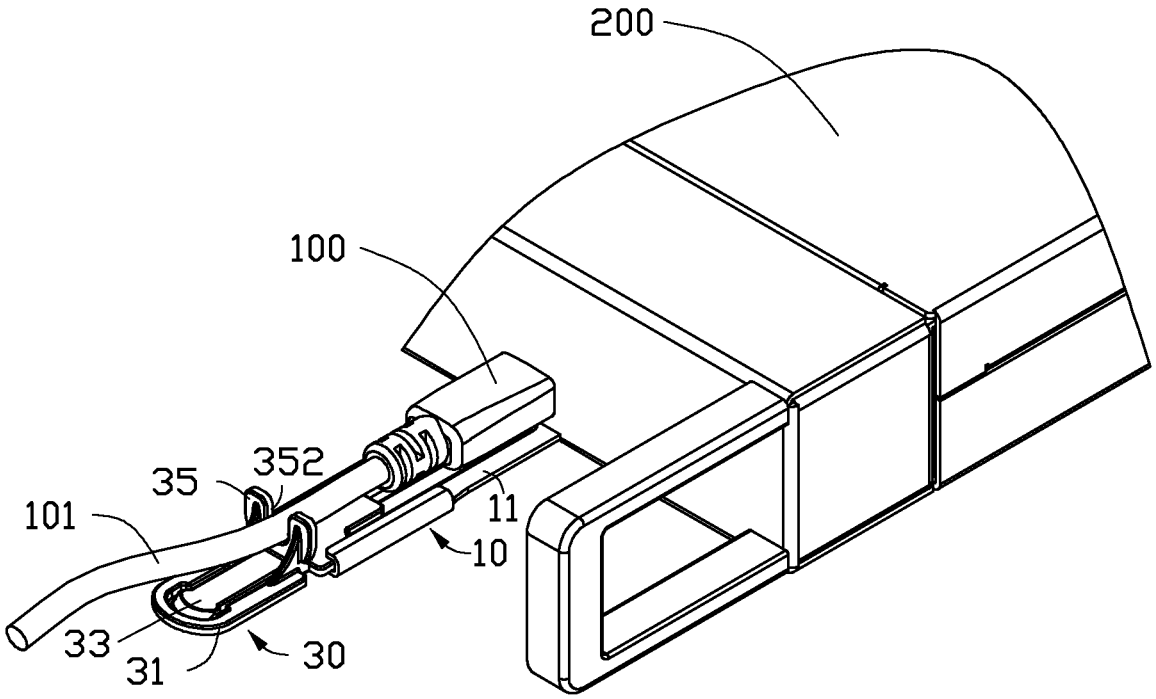
FIGS. 4 and 5 are assembled views of the locking mechanism of FIG. 1, but showing the locking mechanism in different states.
Figure 5:
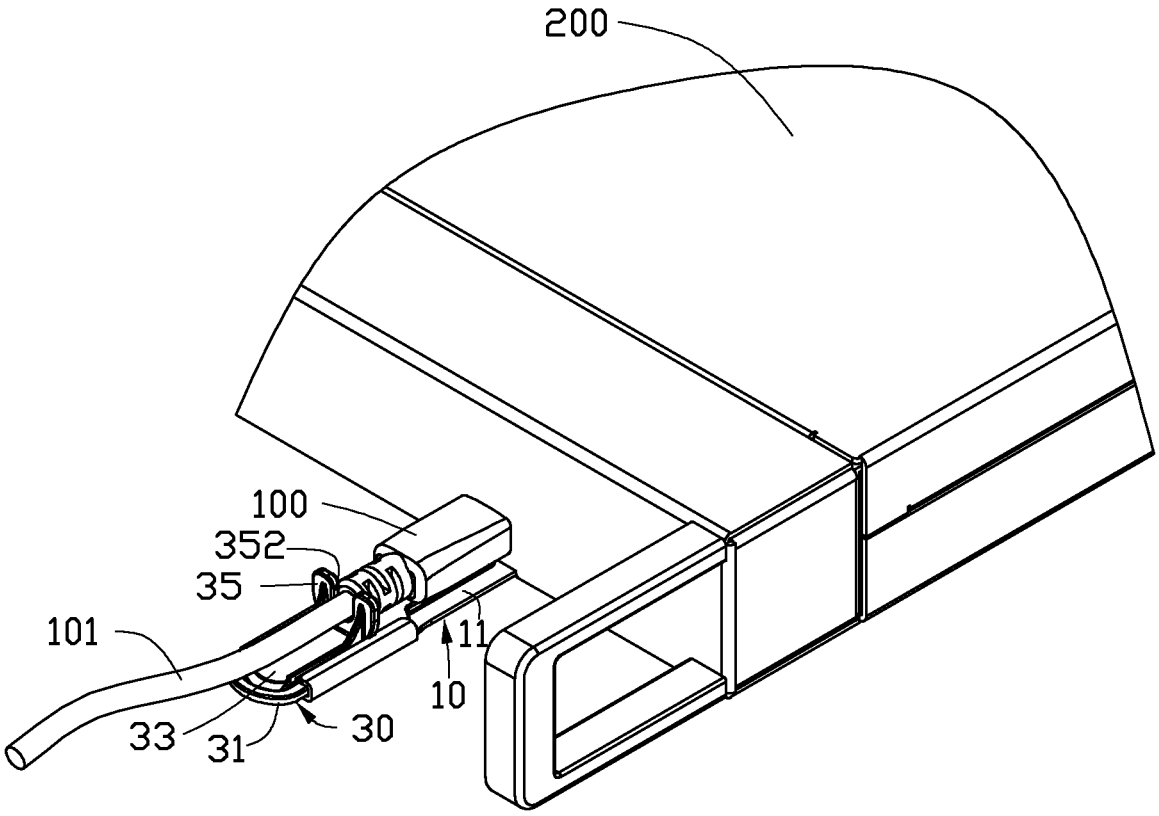

Referring to FIGS. 4 and 5, the rear end of the supporting bracket 10 is secured to the bottom of the information handling device 200, with a plurality of fasteners, such as rivets or screws, correspondingly extending through the mounting holes of the information handling device 200 and fixed in the fixing holes 115 of the supporting bracket 10. The bottom plate 31 of the locking member 30 is slid into the slide passage 110 of the supporting bracket 10. The stopper 372 is slidably received in the slide groove 117, with the stop side 3723 of the stopper 372 substantially perpendicular to the base board 11.

The locking member 30 is slid away from the information handling device 200 to an unlocking position, where a distance between the block 35 and the information handling device 200 is great enough for the first connector 100 being coupled to the second connector 201 of the information handling device 200. When the stopper block 372 engages in the positioning hole 119, the stopping side 3723 abuts against a side bounding the positioning hole 119 to prevent the locking member 30 from sliding any more to disengage from the supporting bracket 10. The first connector 100 is coupled to the second connector 201, with the cable 101 extending through the notch 352 of the block 35. The locking member 30 is slid towards the information handling device 200 to a locking position, where the block 35 abuts against the first connector 100 to sandwich the first connector 100 together with the information handling device 200, and the protrusion 334 is engaged in the retaining hole 112 to stop the locking member 30 from sliding, thereby preventing the first connector 100 from disengaging from the second connector 201 of the information handling device 200.

To detach the first connector 100 from the second connector 201, the operation portion 332 is pushed upwards to tilt the manipulation arm 33 upwards, thereby disengaging the protrusion 334 from the retaining hole 112. The locking member 30 is slid away from the information handling device 200 to the unlocking position. Therefore, the block 35 is spaced from the first connector 100 to enable the first connector 100 to be removed from the second connector 201 of the information handling device 200.

Figure 6:
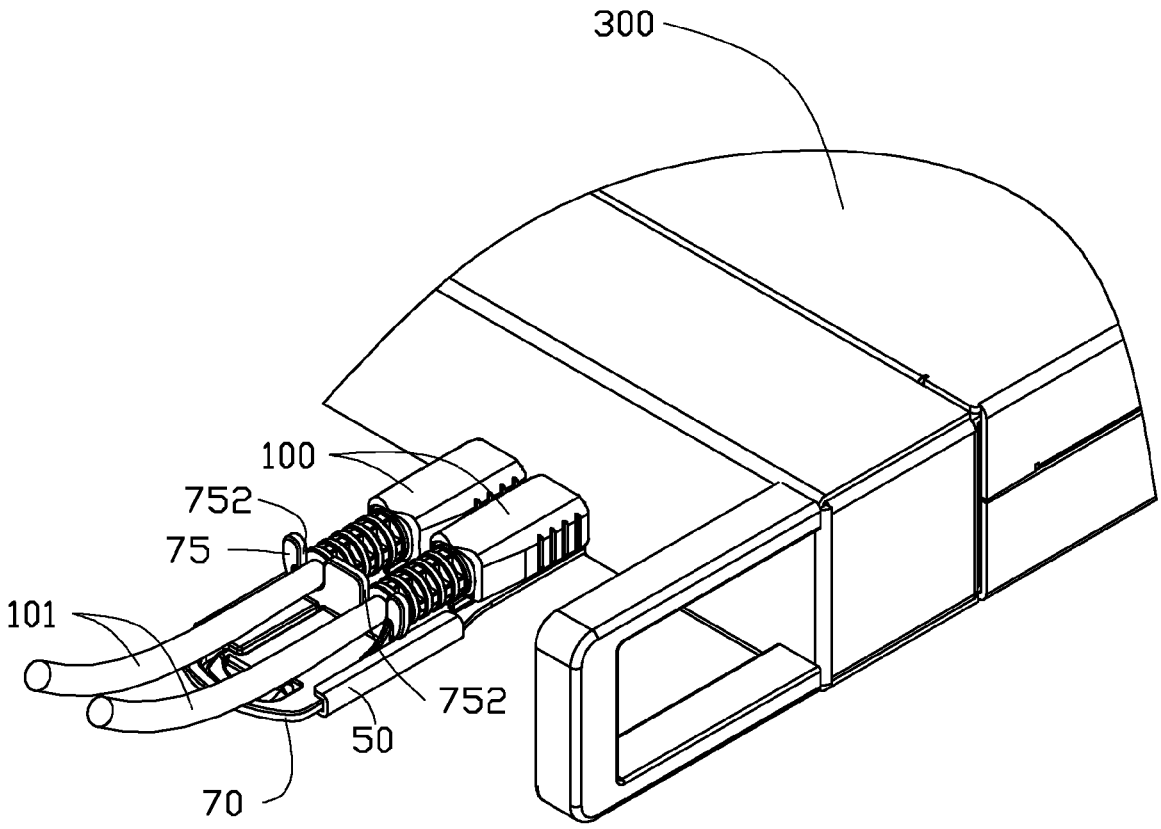
FIG. 6 is an assembled, isometric view of a second embodiment of a locking mechanism, two connectors, two cable respectively extending from the connectors, and an information handling device.

Referring to FIG. 6, a second embodiment of a locking mechanism is used to lock two connectors 100 to an information handling device 300. The locking mechanism includes a supporting bracket 50 and a locking member 70 slidably mounted to the supporting bracket 10. The locking member 70 includes a block 75 defining two notches 752 corresponding to receive two cables 101 respectively extending from the connectors 100. When the connectors 100 are coupled to the information handling device 300, the locking member 70 is slid towards the information handling device 300, until the block 75 abut against the connectors 100, thereby preventing the connectors 100 from disengaging from the information handling device 300.

It is to be understood, however, that even though numerous characteristics and advantages of the present disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A locking mechanism to lock a connector to a device, the locking mechanism comprising:

a supporting bracket fixed to the device, and defining a retaining hole; and a locking member slidably mounted to the supporting bracket, and comprising a block, a resilient manipulation arm and a bottom plate, the manipulation arm cantilevering from the bottom plate, a protrusion formed on a bottom of the manipulation arm, wherein the locking member is slidable between a locking position where the block abuts against the connector to sandwich the connector between the block and the device, and the protrusion is engaged in the retaining hole of the supporting bracket, and an unlocking position where the block is spaced from the connector with a distance between the block and the device being great enough for disengaging the connector from the device.

2. The locking mechanism of claim 1, wherein the supporting bracket comprises a base board and two sidewalls extending up from opposite sides of the base board, a slide passage is bounded by the base board and the sidewalls, the bottom plate is slidably received in the slide passage of the supporting bracket, the block perpendicularly extends up from the bottom plate.

3. The locking mechanism of claim 2, wherein the base board of the supporting bracket defines a slide groove, the locking member further comprises an extension arm extending from the bottom plate, a stopper protrudes from the extension arm and slidably received in the slide groove of the supporting bracket.

4. The locking mechanism of claim 3, wherein the base board of the supporting bracket defines a positioning hole adjacent to an end of the slide groove far away from the device, the stopper of the locking member is engaged in the positioning hole of the supporting bracket in response to the locking member being at the unlocking position.

5. The locking mechanism of claim 1, wherein the bottom plate defines an accommodating hole, the manipulation arm extends into the accommodating hole from a wall bounding the accommodating hole.

* * * * *